US006045279A

United States Patent [19]

Follis

[11] Patent Number: 6,045,279

[45] Date of Patent: Apr. 4, 2000

[54] EASY REACH LOTION APPLICATOR

[76] Inventor: Jake Todd Follis, 4640 Secret Cove, Austell, Ga. 30106

[21] Appl. No.: 09/302,118

[22] Filed: Apr. 29, 1999

[51] Int. Cl.[7] ..... B05C 11/02; A45D 40/26

[52] U.S. Cl. ..... 401/6; 401/174; 401/207

[58] Field of Search ..... 401/6, 174, 207

[56] References Cited

U.S. PATENT DOCUMENTS

| | | | |
|---|---|---|---|
| 3,590,414 | 7/1971 | Gores | 401/207 |
| 5,240,339 | 8/1993 | DeForest et al. | 401/6 |
| 5,341,538 | 8/1994 | Banome | 401/207 |
| 5,360,111 | 11/1994 | Arispe | 401/207 |
| 5,388,700 | 2/1995 | Per-Lee | 401/6 |
| 5,615,962 | 4/1997 | Staub | 401/6 |
| 5,823,206 | 10/1998 | Mapleback | 401/6 |

FOREIGN PATENT DOCUMENTS

| | | | |
|---|---|---|---|
| 524935 | 12/1953 | Belgium | 401/172 |
| 1015239 | 8/1952 | France | 401/172 |

*Primary Examiner*—Charles R. Eloshway
*Attorney, Agent, or Firm*—William B. Noll

[57] ABSTRACT

A hand-held fluid substance applicator for dispensing and applying a lotion, or the like, to the hard-to-reach areas of the body, such as one's back. The applicator includes an elongated handle, and a uniquely designed applicator head assembly that employs a manually activated, floating pressure plate regulator to maintain a positive pressure on the dispensed fluid substance.

5 Claims, 1 Drawing Sheet

EASY REACH LOTION APPLICATOR

FIELD OF THE INVENTION

This invention is directed to the field of personal applicators for applying a lotion/sun screen to a person's body, particularly remote areas of the body, such as the back.

BACKGROUND OF THE INVENTION

The invention relates to an easy reach, hand-held applicator for lotions, and the like, for applying such substances to all area's of the body, especially hard to reach areas of the body, all without the greasy mess of applying the substances by hand, or by the assistance of a companion.

The prior art discloses a number of devices for applying body lotions to one's body at remote portions through the use of an applicator with adjustable lotion dispensing components. Prior art, illustrative of such devices is found in the following U.S. Patents:

a.) U.S. Pat. No. 5,671,497, to Abdo, teaches an applicator for applying substances, such as lotions, to a user's body having a handle, an attachment member, and a pad removably attached to the attachment member. The handle has a rigid portion with a gripping member at one end and an opposite end portion received into the axial opening of a sleeve. An end of a bendable section is removably received into the axial opening opposite the rigid portion. The attachment member includes a flat layer and a formed layer with edge portions secured to the flat layer. A mid portion of the formed layer extends around and is secured to the end of the bendable section opposite the sleeve. The flat face of the attachment member preferably forms a hook component of a hook and loop fastener for easy attachment to a fabric face of a pad.

b.) U.S. Pat. No. 5,573,342, to Patalano, relates to a body lotion applicator system to enable a user to conveniently apply hand cream and other skin preparations to the back and other hard-to-reach areas of the body. Such system comprises a reservoir in a tubular configuration with an exterior surface and an interior surface and having a circular cross-section. The reservoir has a closed upper end with a filling aperture therein and a closed lower end with a first bearing aperture there through. The reservoir also has an intermediate extent there between. A bearing plate is located interiorly thereof adjacent the upper end with passages there through and with a second bearing aperture there through. An application box is secured to the exterior surface of the reservoir adjacent to the upper end. The application box includes a common wall with the reservoir and is formed with a plurality of feed holes extending there through for the passage of lotion to the application box from the reservoir. The application box also has peripheral side walls and an exterior wall with a dispensing hole there through for the passage of lotion to the body of a user from the application box during operation and use.

c.) U.S. Pat. No. 5,240,339, to DeForest et al., discloses a body lotion applicator with an extended applicator head for reaching the back and other portions of the body that are difficult to reach. An elongate arm serves as a handle and conduit for conducting body lotions from a conventional bottle to the applicator head. The applicator head includes a face plate and porous sponge affixed thereto by a retaining ring. The sponge preferably consists of an outer layer of a small cell, open-cell foam and an inner body of a large cell, open-cell foam. The sponge is detachable from the head and is replaceable with a coarse-celled exfoliative sponge or similar sponge assembly.

d.) U.S. Pat. No. 4,961,661, to Sutton et al., relates to a fluid applicator useful for applying a fluid in a uniform and discrete manner to a remote surface, wherein the applicator has a fibrous pad which is saturated and retains the fluid until applied to a surface, a valve or throttle means to control the amount of fluid in the fibrous pad and a telescoping handle element which can be extended to provide an elongate handle for reaching remote areas, and to expose a cylindrical fluid vessel having a flexible wall which is compressed to extrude fluid therefrom and into the fibrous pad.

e.) U.S. Pat. No. 4,483,636, to Meyer, teaches a liquid applicator including a deformable, elongate tubular member having a proximate end and a distal end in which the distal end is an ellipsoidal or spherical structure. The elongate tubular member has therewithin an elongate supply cavity extending the entire length thereof and terminating in an orifice at the distal end of the tubular assembly. The proximate end of the tubular member is the point of entry for the addition of liquid to the applicator. At the proximate end, there is detachably mounted an end cap. In association with the distal end of the applicator is a hollow, dispensing head having a socket means for accomplishing a press-fitable rotational connection with the ellipsoidal or spherical structure of the elongate tubular member.

f.) U.S. Pat. No. 4,078,865, to Moser, discloses a liquid applicator that includes an applicator member for receiving a liquid to be applied, an elongated delivery member therefor, a cover including a removable scraping member and an entry part for engaging a container having the liquid to be applied.

While the prior art, as reflected in the above patents, offers some solutions to assist one in applying a body lotion to hard-to-reach areas of the body, none provide the convenience and assured flow of product from the dispensing device. The manner by which the present invention achieves this and other goals will become apparent in the specification to follow, particularly when read in conjunction with the accompanying drawings.

SUMMARY OF THE INVENTION

This invention relates to a hand-held applicator for dispensing and applying a fluid substance, such as a lotion or sun screen, particularly to remote areas of the user's body. The applicator consists of an elongated handle of sufficient length to reach the middle of one's back, and a uniquely designed applicator head that employs a manually activated, floating pressure plate to maintain a positive pressure on the dispensed fluid. The applicator head, mounted at one end of the handle, comprises a generally circular fluid chamber for receiving the fluid to be dispensed, where the chamber is characterized by a continuous side wall and a base having fluid dispensing openings therein. A removable cover, preferably threaded thereon, is provided to close the chamber. Within the chamber there is a floating pressure plate that is operably depressed by a threaded member extending through the cover, whereby a positive pressure may be maintained on the fluid to be dispensed. Additionally, a removably detachable sponge applicator assembly is provided for mounting exteriorly to the base, such as by a hook and pile type fastening member, known commercially as VELCRO, a trademark, which receives and dispenses fluid passing through the base openings. By this arrangement, one can easily apply a sun lotion, or the like, to one or another's body without the mess of applying the lotion by hand.

Accordingly, an object of this invention is the provision of an easy reach lotion applicator that employs a positive pressure, hence positive flow, of lotion to one's body.

Another object hereof lies in the use of a removably detached sponge head assembly that may be easily cleaned and reused when desired.

Still a further object of this invention is the provision of a cover member that threadably engages the fluid receiving chamber to seal same against leakage, while providing an easy means to refill the chamber when needed.

These and other objects will become more apparent from the description which follows.

DETAILED DESCRIPTION OF PREFERRED EMBODIMENT

Figure 1:
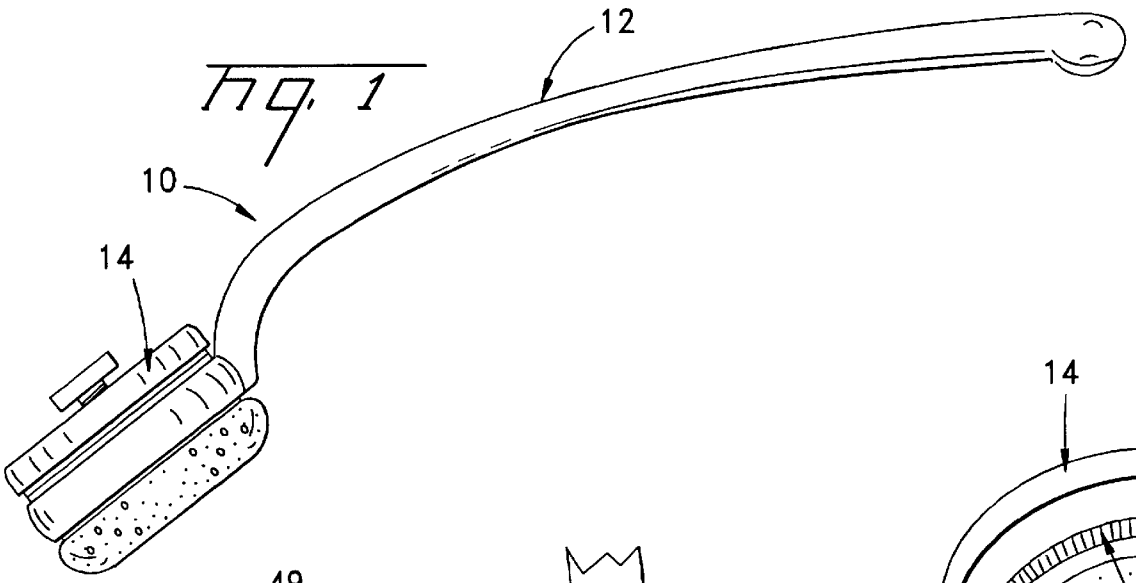
FIG. 1 is a side view showing the hand-held fluid applicator of this invention, where said applicator includes an elongated, arcuate configured handle mounting a fluid applicator head at one end thereof.

The present invention is directed to a hand-held, personal applicator for dispensing and applying a fluid substance, such as a lotion or sun screen, where the applicator is specially suited for applying the fluid substance to those hard-to-reach areas of the body, such as the back. Obviously, the applicator is appropriate for applying the fluid substance to all parts of one's, or another's, body, such as a companion or a child, as it avoids having to first dispense the fluid substance onto one's hand before applying same to the desired areas of the body. Notwithstanding the above, for convenience the applicator will now be described with regard to its preferred use in conjunction with the accompanying Figures, where like reference numerals represent like components or features throughout the several views.

Turning now to the three Figures, FIG. 1 illustrates the applicator 10, where the applicator comprises a handle 12, preferably arcuate configured, and of a sufficient length to ensure the user of reaching the remote areas of the back, and an applicator head assembly 14 from which the selected fluid substance, such as a lotion, may be conveniently dispensed and applied to the body.

Figure 2:
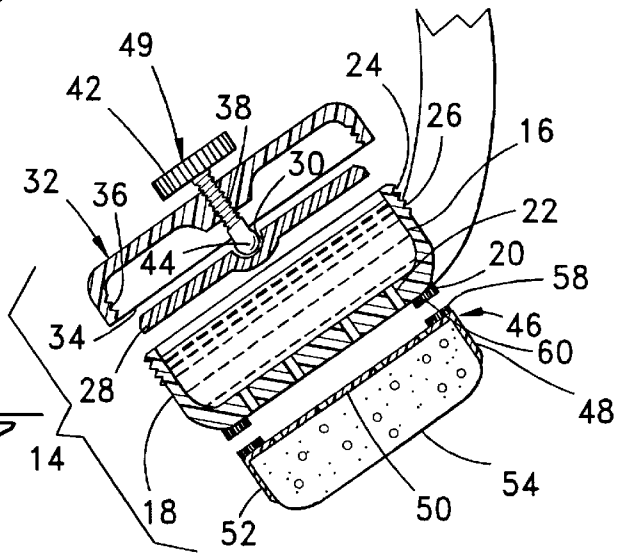
FIG. 2 is an exploded sectional view of the fluid applicator head according to this invention.
Figure 3:
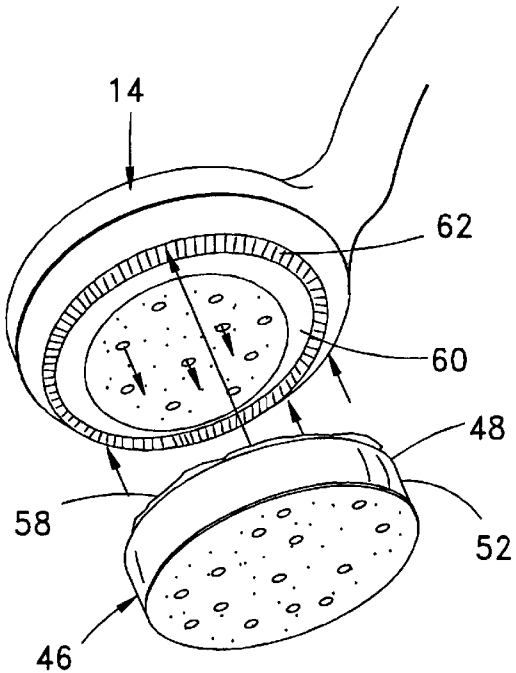
FIG. 3 is a partially exploded perspective view of the fluid applicator head hereof, showing a removably mounted sponge assembly.

FIGS. 2 and 3 best illustrate the details of the applicator head assembly. The applicator head assembly 14 comprises a generally circular fluid chamber 16, or reservoir, defined by a continuous upstanding side wall 18 and a planar base 20 having an array of fluid dispensing openings 22 arranged throughout. The exterior peripheral edge 24 is characterized by annular helical threads 26, for reasons to become apparent hereafter.

Sized for sliding receipt in chamber 16 is a generally circular pressure plate 28 having a central recess 30, where the purpose will be described later. Overriding the chamber 16 and pressure plate 28 is a concave-like cover member 32, characterized by an internal peripheral edge 34 having complementary helical threads 36 for releasably sealing engagement with helical threads 26 about the chamber 16. The cover member 32 features a threaded central opening 38 for threadably receiving a pressure control member 40, where said control member includes a manually activated head 42 at the exterior or outer end, and a balled interior end 44 of a size for sliding receipt in said central recess 30. By this arrangement, a clockwise rotation of the head 42, for example, will lower the balled end 44 causing the pressure plate 28 to move further into the chamber 16 and placing a positive pressure on the chamber contained fluid substance therewithin.

To uniformily apply and disperse the fluid substance from the chamber 16, a sponge assembly 46 is provided. The sponge assembly 46 comprises a housing 48 consisting of a perforated base 50 and a nonpervious, continuous, upstanding wall 52. Contained therewithin is a sponge 54, as known in the art, having a foam-cell density that will allow the dispensing fluid, under pressure, to freely pass therethrough. Since an important feature of this invention is the provision of a removable and replacable sponge assembly 46, the outer surface 56 of the perforated base 50, preferably about the peripheral edge thereof, includes a hook and pile type fastening 58, known commercially as VELCRO, a trademark, see FIG. 3. To removably affix the sponge assembly 46 to the chamber 16, the exterior surface 60 of the base 20 is provided with an annular hook and pile type fastening strip 62. With such arrangement, the sponge assembly 46 may be readily removed for cleaning and/or disposal.

To use and operate the applicator 10 of this invention, the cover member 32 is rotatably removed to expose the interior of the chamber 16. The selected lotion or sun screen is poured into the chamber 16. Before replacing the cover member 32, and its integral pressure control member 40, the head 42 is rotatably withdrawn to bring the balled end 44 close to the underside of the cover member. The pressure plate 28 is positioned on the fluid substance and the cover member is threadably engaged to the chamber 16. By rotating the head 42, and thus causing the pressure plate to descend into the chamber placing pressure on the fluid substance, the fluid substance is pushed through the openings 22 into the sponge assembly 46. With positive pressure maintained on the fluid substance, one is then positioned to dispense and apply the fluid substance as desired.

It is recognized that changes, variations and modifications made be made to the applicator of this invention without departing from the spirit and scope thereof. Accordingly, no limitation is intended to be imposed on the invention except as set forth in the accompanying claims.

What is claimed is:

1. A hand-held applicator for applying a fluid substance to portions of a user's body, said applicator comprising:

a.) an elongated, arcuate shaped handle having a first end for gripping by hand, and a second end; and b.) a fluid applicator head mounted on said second end, said applicator head comprising:

i.) a circular fluid chamber for receiving said fluid substance, where said fluid chamber includes a continuous upstanding wall having an edge, where said wall includes threads adjacent said edge, and a base having fluid substance transmission openings therein, ii.) a circular removable cover having external threads engagable with said threads of said circular fluid chamber, iii.) a floating pressure plate within said circular fluid chamber and operable by manual means in said cover for maintaining and applying pressure to said fluid substance, said floating pressure plate being movable independently of said removable cover, and iv.) a removably detachable sponge applicator head mounted on said fluid applicator head in contact with said base in communication with said transmission openings.

2. The hand-held applicator according to claim 1, wherein said manual means includes a threaded stem extending through said circular removable cover, where the upper end of said stem mounts a fixed rotary member for manually rotating said stem, and the lower end of said stem includes a balled end.

3. The hand-held applicator according to claim 2, wherein said floating pressure plate includes a central recess for slidably receiving said balled end.

4. The hand-held applicator according to claim 1, wherein said sponge applicator head comprises a generally circular housing consisting of a perforated base and a continuous upstanding wall projecting downwardly therefrom and terminating in a continuous planar edge, and a sponge seated therewithin, where said sponge is exposed only along the plane of said continuous edge.

5. The hand-held applicator according to claim 4, wherein said chamber base and said perforated base include complementary hook and pile type fastening members to effect easy attachment or separation from one another.

* * * * *